United States Patent [19]

Banks

[11] Patent Number: 5,025,247

[45] Date of Patent: Jun. 18, 1991

[54] PORTABLE EMERGENCY ALERT SYSTEM

[76] Inventor: James C. Banks, 30924 Mission Avenue, Tavares, Fla. 32778

[21] Appl. No.: 506,293

[22] Filed: Apr. 9, 1990

[51] Int. Cl.[5] ..... G08B 13/00; G08B 21/00

[52] U.S. Cl. ..... 340/574; 340/539; 340/573

[58] Field of Search ..... 340/574, 573, 539, 604

[56] References Cited

U.S. PATENT DOCUMENTS

| | | | |
|---|---|---|---|
| 2,882,914 | 4/1959 | Wiley et al. | 340/604 |
| 3,810,146 | 5/1974 | Lieb | 340/573 |
| 4,063,410 | 12/1977 | Welling | 340/573 |
| 4,110,738 | 8/1978 | Sattin | 340/539 |
| 4,138,670 | 2/1979 | Schneider et al. | 340/693 |
| 4,158,197 | 6/1979 | Takagaki | 340/574 |
| 4,189,721 | 2/1980 | Doell | 340/574 |
| 4,535,324 | 8/1985 | Levental | 340/539 |
| 4,591,836 | 5/1986 | Feigenblatt, Jr. et al. | 340/574 |
| 4,737,751 | 4/1988 | Risk | 340/574 |
| 4,777,478 | 10/1988 | Hirsch et al. | 340/539 |
| 4,855,723 | 8/1989 | Fritz et al. | 340/574 |
| 4,918,433 | 4/1990 | Moore | 340/573 |
| 4,931,772 | 6/1990 | Bechtold | 340/539 |

*Primary Examiner*—Glen R. Swann III

*Attorney, Agent, or Firm*—William M. Hobby, III

[57] ABSTRACT

An emergency alarm system includes a portable digital pulse transmitter having a failsafe mode of activation by the user thereof. A coded pulse signal is transmitted to a decoding device in a digital receiver. The receiver has a latch relay which is connected in circuit with a power source and an alarm device. The alarm system may have a water sensor for setting off the alarm in the event the user falls in the water and may have remotely activated transmitters for locating the user with a receiver and directional antenna.

5 Claims, 1 Drawing Sheet

PORTABLE EMERGENCY ALERT SYSTEM

BACKGROUND OF THE INVENTION

The present invention relates to emergency alarm systems, specifically to personal security alarm systems that can be remotely operated for the purpose of alerting the general public and/or police of an emergency condition.

Prior art devices are known to employ remotely controlled relays for energizing an alarm system in which an RF transmitter is used with a receiver for activating a relay switch and thus energizing the alarm system by means of a suitable power supply. In many of the known devices no provision is made for false alarms, a condition which is often encountered with conventional systems because of the presence of a human factor. For example, in cases where a radio transmitter is used, the transmitter may be inadvertently activated by a sudden jerk of the transmitter by the user thereof or by some such other sudden change in condition as to cause the transmitter to be activated and thus initiate a false alarm.

Prior U.S. Pat. Nos. showing alarm systems can be seen in the following U.S. Pat. Nos.: Cutler et al., 3,641,540 Wireless Alarm System; Bogue et al., 3,825,833 Personal Security Device; Welling, 4,063,410 Digital Watch Including A Signal Transmitter; Hartley, 4,074,269 Burglar Alarm for Use With an Automatic Garage Door Opener; Cataldo, 4,121,160 Switch Means for Radio Alarm Device; Oros, 4,157,540 Wireless Alarm System; Doell, 4,189,721 Personal Alarm System; Cham et al., 4,249,170 Annunciator; Akerberg, 4,347,501 Installation for Transmitting Alarm Signals; Hanson, 4,375,701 Battery or AC Driven Radio Receiver Power Supply; Berg, 4,404,549 Latching Portable Personal Security Alarm; Pyle, 4,446,454 Home Security System; Fulhorst 4,523,178 Wireless Alarm System in Conjunction With At Least One Vehicle; and Levental, 4,535,324 Remote Activated Alarm Triggering Device.

SUMMARY OF THE INVENTION

The present invention provides an emergency alert alarm system which is easy to use, inexpensive to produce, and is fail-safe in operation. The invention provides an alarm system for the elderly, handicapped, those living alone or others who under emergency circumstances would have need for help from their neighbors. Business establishments and industrial plants could also benefit by using the invention on their premises. When activated, the invention would serve as a guide to emergency vehicles, such as police, rescue units and fire departments responding to an emergency call. The alarm system may have a water sensor for setting off the alarm in the event the user falls in the water and may have remotely activated transmitters for locating the user with a receiver and directional antenna.

According to the invention the device is powered from a 110 volt outlet, with a battery back-up, capable of full operation for a 72 hour period after a power failure. The unit consists of both an audio (weatherproof siren) and a visual alarm (strobe light—100,000 candlepower) which can be mounted outside of the dwelling. A radio receiver forms part of the system and has a range of approximately 300 feet. When the receiver is triggered by a transmitter, the outside alarm will remain operating until the reset button is pushed manually, turning the alarm system off.

Two types of transmitters are provided, one a "panic button" type which can be clipped to a belt or clothing, carried in a pocket, placed on a nightstand or elsewhere as desired. The other is a 1½ diameter by ¾" thick transmitter which can be worn at all times as a pendant on a chain around the neck, attached to a key ring, or VELCRO-fastened to a wrist band, or carried in a purse. The latter unit has two recessed push buttons to be squeezed simultaneously, thus virtually eliminating the issuance of false alarms.

The system according to the invention has 256 separate codes one of which may be selected, thereby eliminating interaction between similar systems, such as automatic garage door openers, in the area. The invention operates at 16 volts maximum and can be wired with doorbell (20 ga.) wire using color coded terminals.

The invention is especially useful for a Neighborhood Watch Program, now used with great success for deterring crime in many areas throughout the nation. Also, the invention has use in mobile home parks and large apartment and condominium complexes, and when activated would be of great help to emergency personnel in locating the particular unit in need of emergency services.

The invention additionally provides for simple installation, low operating costs—about the same as an electric clock—requires no mechanical parts to wear out, and will operate with an unlimited number of transmitters.

The invention is further suitable as a deterrent alarm for warding off intruders and the like and concomitantly summoning aid, should there be evidence of intrusion taking place where the person carrying the transmitter is located.

The invention may incorporate a circuit which actuates the alarm if the user falls in a swimming pool or other body of water and may include a single receiver to remotely turn on the transmitter so that the user can be located with a directional receiver.

These and other objects of the present invention will become apparent from a reading of the following specification, taken in conjunction with the enclosed drawings.

DETAILED DESCRIPTION OF THE PREFERRED EMBODIMENT

Figures 1, 2, 3, 4, 5, 6:
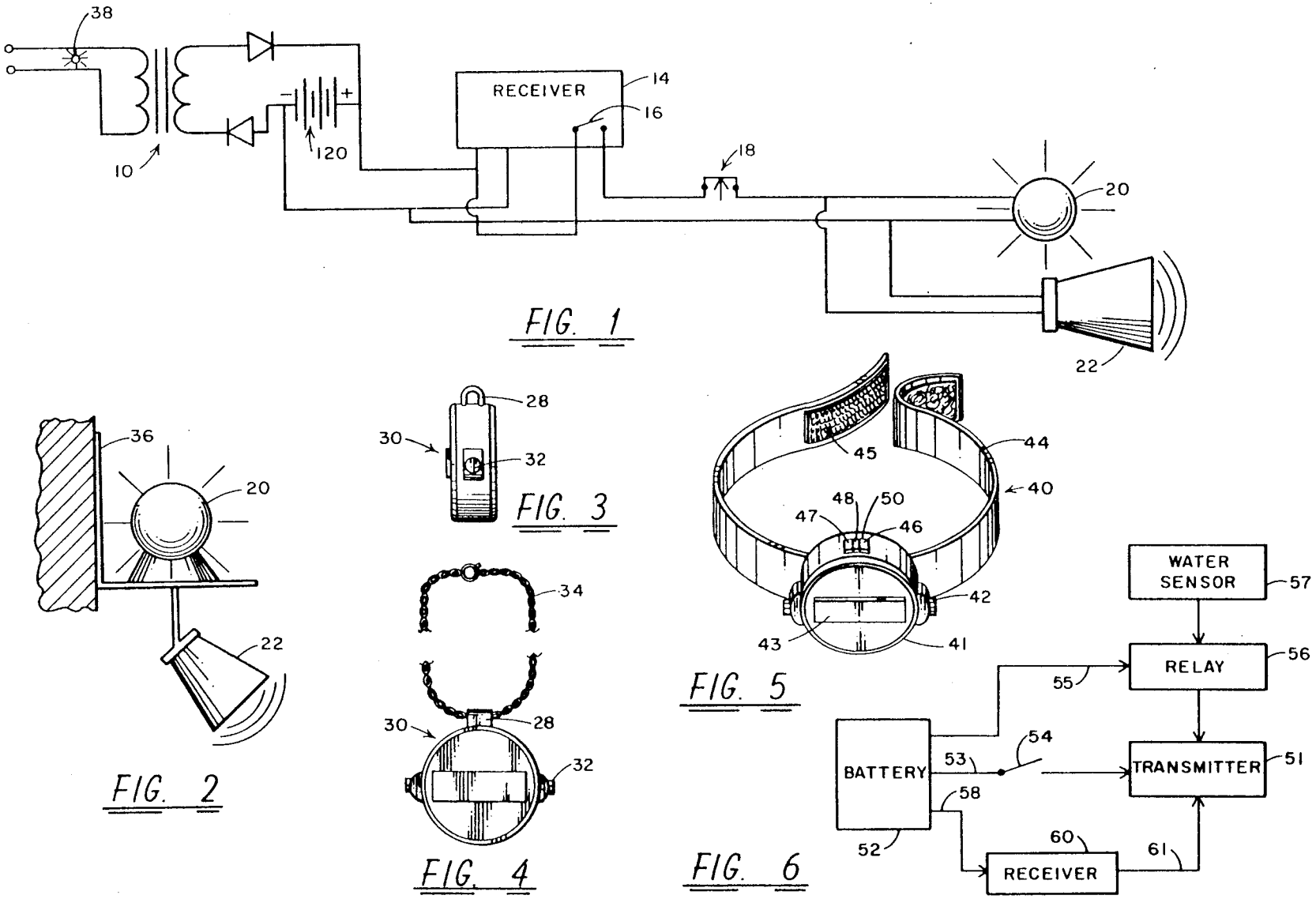
FIG. 1 is a schematic illustration of the circuit using block elements.
FIG. 2 is a schematic illustration of the horn/light configuration used with the invention.
FIG. 3 is a side elevation of a portable transmitter.
FIG. 4 is a front elevation of the portable transmitter of FIG. 3 having a chain thereon.
FIG. 5 is a front perspective view of a portable transmitter attached to a wrist band.
FIG. 6 is an electrical block diagram of a circuit for the portable transmitter.

Referring now to FIG. 1, there is shown a 16 V transformer 10 having a suitable 110 V input which is connected to a rechargeable battery source 12 having a 12 volt D.C. output. The battery source 12 will furnish 1.2 ampere-hours of power after interruption of the AC outlet. Normally, however, the AC outlet, transformed and rectified, will provide a 12 V D.C. supply to the system as well as, via suitable means, provide a trickle charge to the battery 120. The battery output is shown connected to a receiver device 14 of known design which is a suitable RF single channel receiver having a latching relay output 16. Such receivers normally have advanced digital coding, that is, the user can choose one of 256 discrete codes in which four correct 8-bit words are required to operate the receiver's latch relay. A reset 18 is suitably provided for resetting the device for ready operation once it has been put to use for initiating an emergency alarm. The circuit is seen connected to a strobe light device 20 and in parallel thereto to a sound alarm 22 device of the whooper siren type.

In FIG. 2 is shown the alarm system comprising the strobe light fixture 20 and the whooper system alarm 22 mounted on a common angle bracket 36, which can be suitably mounted to an interior or exterior wall of a building where the public or a specific person may be alerted.

In FIGS. 3 and 4, there is shown an embodiment of a transmitter in the form of crystal controlled RF transmitter of extremely small size, in the shape of pendant 30 having two opposed push buttons switches 32 for activating the transmitter.

The transmitter 30 can be worn around the neck by means of a suitable necklace 34. With this transmitter both push buttons 32 must be pressed simultaneously to activate the device, thus virtually preventing a false alarm, should either one of the push buttons 32 be pushed accidentally, which of course would have no effect.

The operation of the device is as follows. The user of the invention would normally carry the transmitter 30 on his or her person and would push the activation buttons 32 of the transmitter 30 when an emergency condition is sensed by the operator. Thus activated, the transmitter encodes a transmission signal to the receiver which suitably decodes the transmitted signal and energizes the latch relay 16, thus completing the circuit to the alarm system 20, 22 from the power battery source 120. The alarm will continue until the reset button 18 is pushed to turn the system off and thus ready the circuit for operation again. The effective distance between transmitter and receiver is about 300 feet but can be greater as desired.

Turning now to FIG. 5, a portable wrist mounted transmitter 40 is illustrated having a portable transmitter in a casing 41 along with switches 42 for activating the transmitter located on both sides thereof and having a door 43 for entering the casing 41 for changing the battery. Transmitter casing 41 is mounted to a strap 44 having VELCRO 45 on the ends thereof for strapping to a person's wrist or leg as desired and is advantageously attachable to a small child. A water sensor 46 protrudes from the side of the casing 41 and has a pair of dissimilar metals 47 and 50 separated by an insulator 48 and acts as a water sensor because the water from a swimming pool or lake or ocean will cover the dissimilar metals 46 and 47 across the insulator 48 and act as an electrolyte to generate a galvanic voltage which can activate the transmitter to transmit a signal frequency to actuate the receiver 14 to set off an alarm.

Turning to FIG. 6, a block diagram of a circuit has a transmitter 51 having a battery 52 which actuates the transmitter to transmit a single frequency tuned to the receiver 14 (of FIG. 1) any time a voltage is applied from the battery to the transmitter 51. A conductor 53 extends from the battery through a manual switch 54 for actuating the transmitter manually such as with the switches 42 in FIG. 5 or 32 in FIG. 4. Conductor 55 connects the battery to a latching relay 56 which is also connected to the water sensor 57 which sensor has two dissimilar metals, as shown in FIG. 5, separated by an insulator and will generate a voltage any time the dissimilar metals are immersed in an electrolyte, such as chlorinated water in a swimming pool. The voltage from the water sensor 57 actuates the relay 56 to direct the voltage from the battery 52 through the connector 55 to the transmitter 51 to actuate the transmitter. This embodiment allows both an individual to manually actuate an alarm in case of a fall but also allows the system to be attached to a small child or disabled person and immediately sound a warning in case the individual falls into a pool. A third conductor 58 is connected from the battery to a receiver 60 which can be a simple FM receiver circuit tuned to receive a single frequency tone which activates a relay therein to direct the voltage through the conductor 58 through a conductor 61 to the transmitter 51 to turn on the transmitter. This allows a person with a simple highly directional remote receiver using a highly directional antenna to remotely turn on the transmitter 51 to generate a single tone by the actuation to the receiver 60 and then through the directional receiver point the antenna in the direction of the strongest signal and locate the person wearing the transmitter 51 in the event the person becomes lost while walking in a neighborhood or nearby area. These added features can still be manufactured quite inexpensively and provide an alert system for use by elderly people as well as young children and may be worn by anyone taking a walk in the neighborhood to allow the wearer to sound an alarm in the event of danger.

However, the present invention should not be construed as limited to the forms shown which are to be considered illustration rather than restrictive.

I claim:

1. A portable emergency alarm system comprising:

a power source;

a digital receiver having a latch relay connected in circuit with said power source;

at least one of a sound alarm and light means connected in circuit with said latch relay;

a portable digital transmitter having a failsafe activating means for triggering said receiver means latch relay and thereby energizing said sound alarm and light means; and a water sensor attached to said portable digital transmitter to energize an alarm system whenever the transmitter is immersed in a body of water, said water sensor having a pair of dissimilar metal electrodes spaced by an insulator for generating a galvanic current for actuating said transmitter.

2. A system in accordance with claim 1 which said water sensor is connected to a latching relay for actuating said transmitter.

3. A system in accordance with claim 2 including a receiver switch for turning on said transmitter whereby said person wearing said transmitter can be located with a remote directional receiver.

4. A system according to claim 1, wherein said fail safe activating means comprises a pair of oppositely disposed activating buttons.

5. A system according to claim 4, wherein said transmitter is contained in a pendent housing having a necklace means for being worn by an operator thereof.

* * * * *